US011247838B2

(12) United States Patent
Cedergren

(10) Patent No.: US 11,247,838 B2
(45) Date of Patent: Feb. 15, 2022

(54) COUPLING DEVICE FOR DISPENSING OF FOOD

(71) Applicant: Asept International AB, Lund (SE)

(72) Inventor: Daniel Cedergren, Lund (SE)

(73) Assignee: Asept International AB, Lund (SE)

( * ) Notice: Subject to any disclaimer, the term of this patent is extended or adjusted under 35 U.S.C. 154(b) by 0 days.

(21) Appl. No.: 16/642,353

(22) PCT Filed: Sep. 27, 2018

(86) PCT No.: PCT/SE2018/050986

§ 371 (c)(1),
(2) Date: Feb. 26, 2020

(87) PCT Pub. No.: WO2019/066708

PCT Pub. Date: Apr. 4, 2019

(65) Prior Publication Data

US 2021/0070532 A1 Mar. 11, 2021

(30) Foreign Application Priority Data

Sep. 27, 2017 (SE) ..... 1751197-3

(51) Int. Cl.
*B65D 83/00* (2006.01)

(52) U.S. Cl.
CPC ..... *B65D 83/0072* (2013.01)

(58) Field of Classification Search
CPC ..... B65D 83/0072
USPC ..... 222/81, 91, 89, 541.2
See application file for complete search history.

(56) References Cited

U.S. PATENT DOCUMENTS 547,370 A * 10/1895 Chalefou ..... 222/81
1,016,135 A * 1/1912 Foans ..... B67B 7/26 222/90
1,465,793 A * 8/1923 Schilling ..... B67B 7/26 222/90
1,965,271 A * 7/1934 Wharton ..... F16N 37/02 222/95
2,733,836 A * 2/1956 Switzer ..... F16N 3/12 222/82

(Continued)

FOREIGN PATENT DOCUMENTS

DE 19645532 5/1998
GB 2163136 2/1986
WO WO 2010/118044 10/2010

OTHER PUBLICATIONS

International Search Report and Written Opinion for International App. No. PCT/SE2018/050986, dated Jan. 4, 2019, in 13 pages.

(Continued)

*Primary Examiner* — Patrick M. Buechner
*Assistant Examiner* — Michael J. Melaragno
(74) *Attorney, Agent, or Firm* — Knobbe Martens Olson & Bear, LLP

(57) ABSTRACT

The present invention relates to a coupling device (1) for connection to a flexible container (3) comprising a plastic foil for dispense of food product (2) in fluid form out of the same, comprising an outlet valve (10) with a first end comprising at least one hole-creating part (11) for penetration of the container on connection to the same and a through-flow channel (20) which merges into a second end for further transfer of food product.

14 Claims, 15 Drawing Sheets

(56) References Cited

U.S. PATENT DOCUMENTS 2,925,199 A * 2/1960 Brookshier ..... B65D 5/60 222/91
2,954,768 A * 10/1960 Hamilton ..... A61M 5/162 604/274
3,030,954 A * 4/1962 Thornton, Jr. ..... A61M 5/162 604/251
3,549,049 A * 12/1970 Weber ..... B67B 7/26 222/91
3,768,698 A * 10/1973 Corty, Sr. ..... B67B 7/26 222/91
3,831,814 A * 8/1974 Butler ..... A61M 5/162 222/81
3,927,803 A * 12/1975 Weber ..... B65D 5/748 222/91
3,973,698 A 8/1976 Kato
4,040,389 A * 8/1977 Walters ..... A01K 5/0225 119/52.1
4,712,714 A * 12/1987 Mucciarone ..... B67B 7/26 222/91
4,765,511 A * 8/1988 Clements ..... B65D 47/242 222/479
4,826,500 A * 5/1989 Rautsola ..... A61J 1/1406 222/91
5,090,596 A * 2/1992 Knight ..... B67D 3/042 222/517
5,325,995 A * 7/1994 Harrison ..... B67B 7/26 222/81
5,368,206 A * 11/1994 Sandrin ..... B05C 17/00583 222/326
5,573,047 A * 11/1996 Akin ..... B67B 7/26 141/330
5,855,298 A * 1/1999 Teetsel, III ..... B67B 7/26 222/81
5,894,956 A * 4/1999 Keith ..... B67B 7/26 222/1
6,223,940 B1 * 5/2001 Quinn ..... B65D 75/5877 222/81
6,364,163 B1 * 4/2002 Mueller ..... B05B 11/048 222/105
6,564,970 B1 * 5/2003 Walch ..... B05C 17/00586 222/82
7,937,836 B2 * 5/2011 Gabriel ..... A01K 1/0356 29/890.124
8,206,034 B2 * 6/2012 Keen ..... B65D 51/226 383/202
9,409,760 B1 8/2016 Lichtefeld, Sr.
2005/0121464 A1 * 6/2005 Miller ..... B67D 3/04 222/81
2008/0029540 A1 2/2008 Johnson
2009/0024104 A1 * 1/2009 Keller ..... A61M 5/2459 604/411
2010/0200611 A1 8/2010 Pritchard
2011/0031273 A1 * 2/2011 Macler ..... B67B 7/24 222/81
2012/0065608 A1 * 3/2012 Costello ..... B65D 47/2031 604/403
2013/0008926 A1 1/2013 Bell
2013/0233886 A1 * 9/2013 Long ..... B65D 35/08 222/95
2013/0270293 A1 * 10/2013 Dresser ..... B65D 75/5877 222/83
2014/0048557 A1 * 2/2014 Barron ..... B65D 5/748 222/81
2014/0263435 A1 * 9/2014 Macler ..... B67D 3/0029 222/81
2017/0008685 A1 1/2017 Stever et al.

OTHER PUBLICATIONS

Swedish Search Report for Swedish App. No. 1751197-3, dated Apr. 27, 2018, in 3 pages.

* cited by examiner

COUPLING DEVICE FOR DISPENSING OF FOOD

TECHNICAL FIELD

The present invention relates to a discharging device comprising valve parts for dispensing of liquid food or food in fluid form from a food container. The valve parts are adapted to penetrate the food container with the intent of emptying food out of the food container, which is designed to collapse as the food is fed out of it.

BACKGROUND

Within the food industry there are many examples of devices for dispensing of foods.

Examples of devices for penetrating food containers with the intent of enabling discharge of product out of the containers can be found e.g. in WO 2008/115047 A1 and US 2010/0243671 A1.

One disadvantage of such known discharging devices when they are applied to containers made of plastic foil is, among others, that they are difficult to handle, with risk of spillage of food product and increased risk of leakage of food product, and lowered storage ability for the food in them.

SUMMARY OF THE INVENTION

One object of the invention is to provide a device for dispensing of food product in fluid form from flexible containers, which solves or at least reduces the above-mentioned problem.

Another object of the invention is to provide a device for safe, simple and quick discharge of food product in fluid form from a flexible container made from plastic foil and designed to collapse as the food is discharged from it.

Yet another object of the invention is to provide a device for leakage-proof discharge of a food product in fluid form out of a flexible container made of plastic foil, which creates a distinct and exactly reproducible penetration of the container when connected to the same.

One more object of the invention is to provide a device for leakage-free discharge of food product in fluid form out of a flexible container made of plastic foil which creates a distinct and exact and reproducible and uniform/symmetric penetration of the container when connected to the same.

An additional object of the invention is to provide a device for leakage-free discharge of a food product in fluid form from a flexible container made from plastic foil, which device creates a distinct and exact and uniform/symmetric connection with increasing improvement of the sealing during penetrating connection of the device in the container and retained capacity of holding tight after the penetrating connection of the device in the container.

Yet another object of the invention is to provide a device for leakage-free discharge of food product in fluid form out of a flexible container made from plastic foil, which gives a distinct and exact and uniform/symmetric penetration which increases continuously and thus improves and also retains the tightness between the device and the container during and after the device has penetrated into and through the container's plastic foil.

Yet another object of the invention is to provide a device that creates a distinct and exact, and uniform/symmetric penetration of the plastic foil in a flexible container because the device is provided with at least one point equipped with at least one tooth which works as at least one cutting element with at least two sides or corners or edges against which the plastic foil is pressed/pushed until it breaks in a controlled manner.

A further object of the invention is to provide a device which creates a distinct and repeatable and easy penetration of the plastic foil in a flexible container because the device is provided with at least one point equipped with more than one tooth which works as a cutting element against which the plastic foil is pressed/pushed until it breaks because the plastic foil is overloaded concurrently at several small surfaces/points in the same manner as a spontaneous and non-prepared perforation of the plastic foil.

Yet another object of the invention is to provide a device that creates a distinct and exact repeatable and easy penetration of the plastic foil in a flexible container in that the device is provided with at least one point equipped with more than one tooth that works as a cutting element against which the plastic foil is directly pressed/pushed until it breaks because the plastic foil is overloaded at several small surfaces/points by means of a thus achieved pointed stretch of the plastic foil creating small direct initial breaks in the same, which breaks propagate in a controlled manner.

Yet another object of the invention is to provide a device for leakage-free discharge of a food product in fluid form out of a flexible container made from plastic foil that gives a continuously increasing and improved and retained sealing between the device and the container during and after the device has penetrated into and though the container's plastic foil during and after the device has penetrated into and through the container's plastic foil because the pressure per surface area between the device's tightness-providing surface and plastic foil increases, the further the device is pressed into the container all the way until a final/bottom position has been reached.

Yet another object of the invention is to provide a device for leakage-free discharge of food product in fluid form out of a flexible container made from plastic foil that eliminates the risk of leakage by designing an outermost hole-creating pointed part of the device, for penetration of the foil so that this outermost pointed part for hole-creation in the foil directly continues into at least one radially protruding edge which extends from the outermost free pointed part in the discharge direction of the food product and towards an through-flow channel for discharge of food product.

These objects are achieved with the aid of a device for discharge of food product in fluid form kept in a flexible container according to the related in-dependent claim, with preferred variants defined in the related dependent claims.

The device according to the invention concerns a coupling device for connection to a flexible container comprising a plastic foil for dispensing of food product in fluid form out of the same, comprising an outlet valve with a first end comprising at least one hole-creating part for penetration of the container and its plastic foil when connecting to the same and a through-flow channel which merges into a second end for transfer of food product, where an outer portion of the hole-creating part is configured as an axially protruding spear point, which point is arranged/adapted to merge into at least one radially protruding edge configured to extend axially from the point in direction of the dispense for food product and connect to an inlet orifice at the through-flow channel, wherein food product can be discharged from the container via orifice openings after the container has been penetrated by the spear point which is provided with at least one outwards pointing tooth which works as at least one cutting element with at least two edges or corners or cutting edges configured to create a cutting effect on the container's plastic foil in at least two places in the plastic foil, and the through-flow channel is configured with a conical outer mantle surface which has an increasing size in a direction away from the inlet orifice, wherein the point and at least one protruding spear point edge comprises at least one such outward pointing tooth configured as a step that mainly faces radially outwards with at least one outermost cutting edge being sharp and extending in a plane substantially perpendicular to the point's and/or spear point edge's axial extension.

The point of the hole-creating part is in yet another embodiment designed as an axially protruding spear point which is angular or has edges, whereby at least one, two, three or more radially protruding edges physically connect(s) directly to this axially protruding spear point and which radially protruding edge(s) extend in the direction towards the through-flow channel, wherein a point and/or at least a protruding spear head point comprises at least one tooth designed as a step which faces substantially/essentially radially outwards with at least one outermost cutting edge which is sharp and extends in a plane substantially/essentially perpendicular to the axial extension of the point and/or the spear point edge.

The point of the hole-creating part is in one embodiment provided as an axially protruding edge-equipped/edge-shaped spear point, whereby at least one, two, three or more radially protruding edges that physically connect(s) directly to this axially protruding spear point and which radially protruding edge(s) extend in the direction towards the through-flow channel, wherein the point of the hole-creating part and at least one protruding spear point edge comprises at least a tooth each, designed as a step which faces substantially/essentially radially outwards with at least one outermost cutting edge which is sharp and extends in a plane substantially/essentially perpendicular to the axial expanse of the point and/or the spear point edge.

In yet another embodiment, the point of the hole-creating part is designed as an axially protruding triangular spear point, which directly from the outermost spear part passes into three radially protruding edges which extend in the direction of the through-flow channel, whereby the point of the hole-creating part and at least one protruding spear point edge comprises at least one tooth designed as a step that faces substantially/essentially radially outwards with at least one outermost cutting edge which is sharp and extends in a plane substantially/essentially perpendicular to the axial expanse of the point and/or the spear point edge.

In one embodiment the point of the hole-creating part is configured as an axially protruding edge-equipped/edge-shaped spear point, which merges into one or more, preferably two, three or more, radially protruding edges which extend(s) in the direction towards the through-flow channel.

In another embodiment, the point of the hole-creating part is configured as an axially protruding triangular spear point, which merges into three radially protruding edges which extend in the direction towards the through-flow channel.

In yet another embodiment, the coupling device comprises protruding edges of the hole-creating part, which connect to the inlet orifice of the through-flow channel and separates the inlet orifice into three openings.

In one embodiment, the coupling device is adapted for a container made out of plastic foil.

In another embodiment, the coupling device comprises a through-flow channel configured with a conical outer mantle surface which has an increasing size and/or circumference and/or diameter in the direction away from the inlet orifice.

In one embodiment, the coupling device is adapted for penetration of a container that is adapted to be housed in an outer container so that its plastic foil is stretched and therein aligned with and/or at least partly bulges through a counterforcing end portion in the outer container.

In yet another embodiment the coupling device comprises that the axial centre axis for the hole-creating part's point and the axial centre axis for the through-flow channel and its inlet orifice and the axial centre axis for the outflow valve coincide or diverge relative to each other's expanse.

In other embodiments the coupling device comprises protruding spear point edges on the hole-creating part, which are arranged to extend along planes being parallel to the point and/or the through-flow channel and/or its inlet orifices and/or the axial centre axis of the outlet valve and/or the axial centre axes for all these parts or arranged to extend along planes being parallel with either the axial centre axis of the point, the through-flow channel or its inlet orifice or outlet valve's axial centre axis, or the axial centre axis of all these parts.

Further, in another embodiment, the coupling device comprises a point and/or at least a protruding spear point edge which comprises at least one tooth designed as a step which faces substantially/essentially radially outwards with at least an outermost cutting edge which is sharp and extends in a plane substantially/essentially perpendicular to the axial extension of the point and/or the spear point edge.

In one embodiment the coupling device comprises at least one tooth on the point and/or at least one spear point edge which is configured at least partially as a thread segment that substantially/essentially faces radially outwards with at least one outer thread part or profile edge which is sharp and extends in a plane at least partially angled towards the point's and/or the spear point edge's axial expanse.

In yet another embodiment the coupling device comprises a point that comprises at least two teeth and/or at least two of the spear point edges, are configured with at least one tooth each, wherein each tooth is configured as a step that substantially or essentially faces radially outwards with at least one outer cutting edge which is sharp and which extends in a plane substantially/essentially perpendicular to the axial expanse of the point and/or the spear point edge.

In another embodiment the coupling device is developed to cooperate with a counterforce end part in the outer container which is equipped with a central opening through which the bulging part of the container is adapted to be distended and aligned with the hole-creating part before its penetration.

In another embodiment the coupling device comprises at least one radially protruding spear point edge configured with an axial expanse creating an at least partially conical outer mantle surface with an increasing size and/or radius and/or circumference and/or diameter in a direction away from the spear point.

In yet another embodiment the coupling device comprises at least one radially protruding spear point edge which is in direct connection with the spear point, which means that the spear point physically merges directly into at least one spear point edge or merges directly into this one spear point edge or merges directly into more than one edge, e.g. two, three or more edges.

In accordance with which and/or any embodiment(s) above, an additional advantage is achieved through the arrangement of the coupling device with at least one directly against the spear point connecting radially protruding spear point edge enabling such a penetration of the plastic foil that the plastic foil itself is cut up quickly and directly when penetrated, as the spear point and its edge has at least one tooth each, in such a way that no pieces of plastic foil come loose and no leakage-creating cracks are created in the plastic foil, so that when the foil is thread onto the coupling device, the foil performs a self-sealing function around the coupling device.

DESCRIPTION OF THE FIGURES

The invention will be described in more detail with reference to the enclosed figures, which show examples of presently preferred embodiments of the invention.

DESCRIPTION OF EMBODIMENTS

Figure 1:
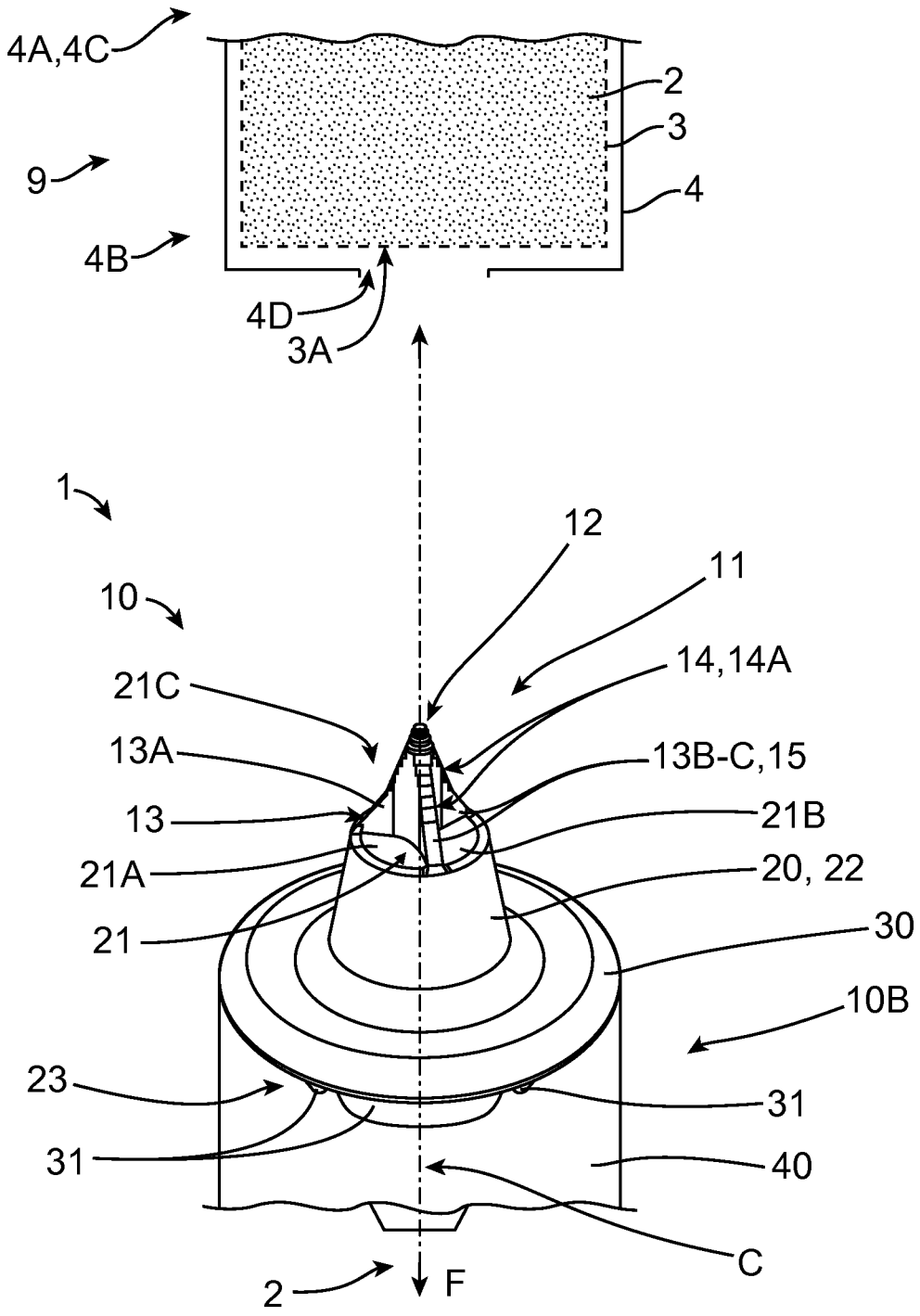
FIG. 1 shows in perspective a coupling device and a dosing device as separate parts in a disassembled state or during/before assembly for food dispensing/feeding out of a container according to the invention.
Figure 2:
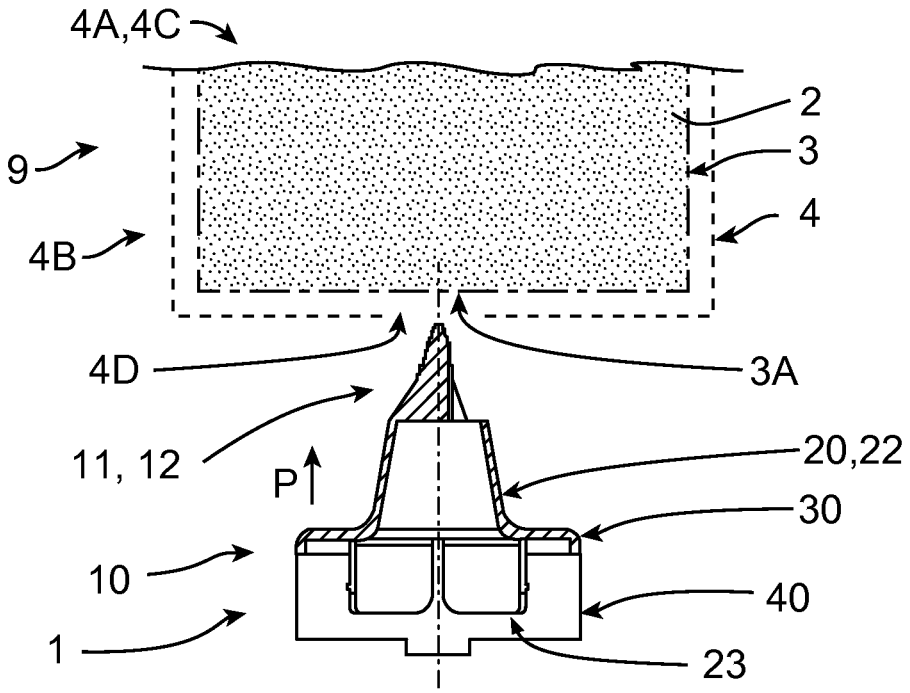
FIGS. 2 and 6 show in section from the side a first position with lining up of the coupling device and its outlet valve in FIG. 1 relative to the dosing device before penetration into, i.e. penetration of the food container enclosed in the dosing device.
Figure 3:
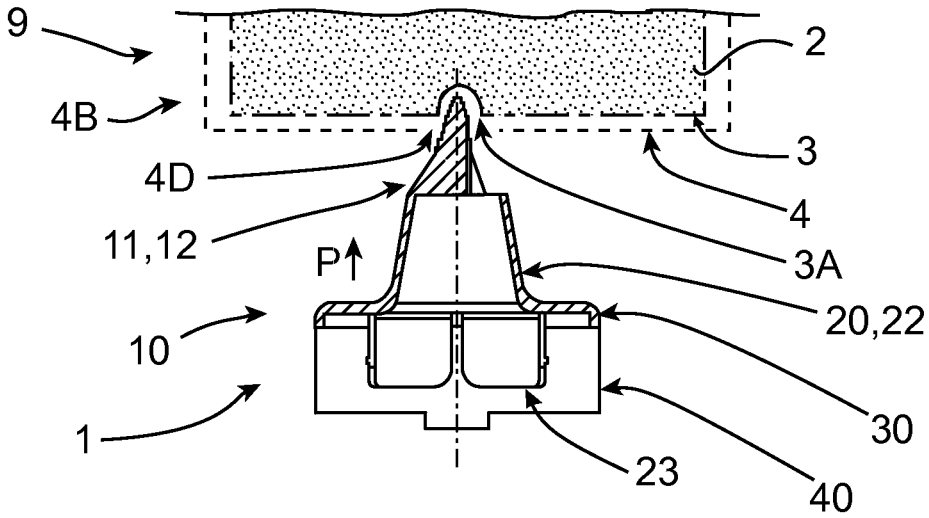
FIGS. 3 and 7 show in section and from the side a second position with the coupling device according to FIG. 2 just before/during penetration through the food container in the dosing device.
Figure 4:
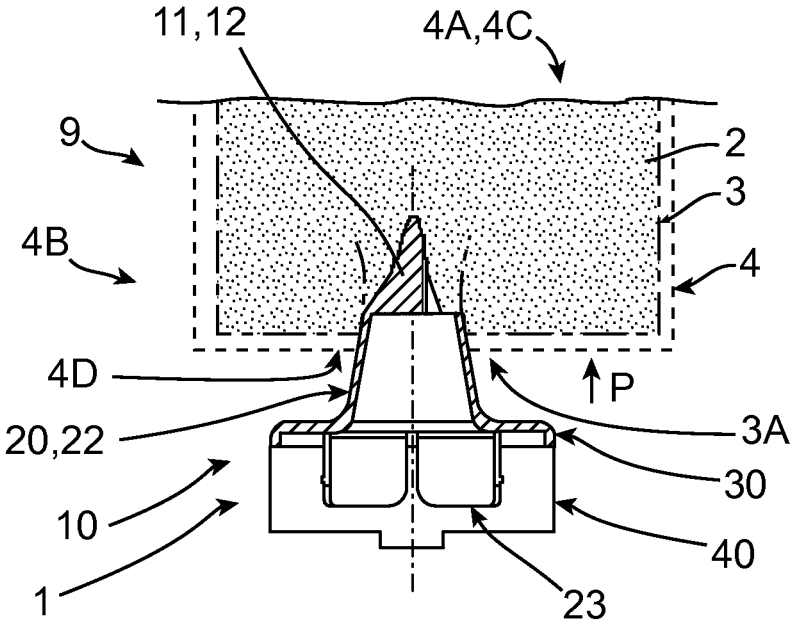
FIGS. 4 and 8 show in section from the side a third position with the coupling device according to FIGS. 2 and 3 during/after penetration through the food container in the dosing device.
Figure 5:
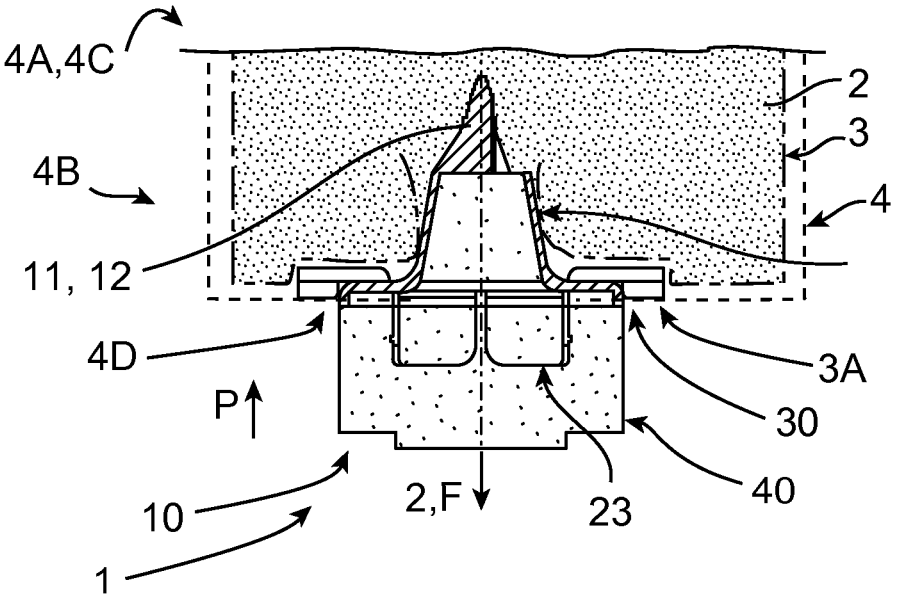
FIGS. 5 and 9 show in section and from the side a fourth and final position or end/bottom position with the coupling device according to FIGS. 2 to 8 after penetration in/penetration through the food container in the dosing device.
Figure 6:
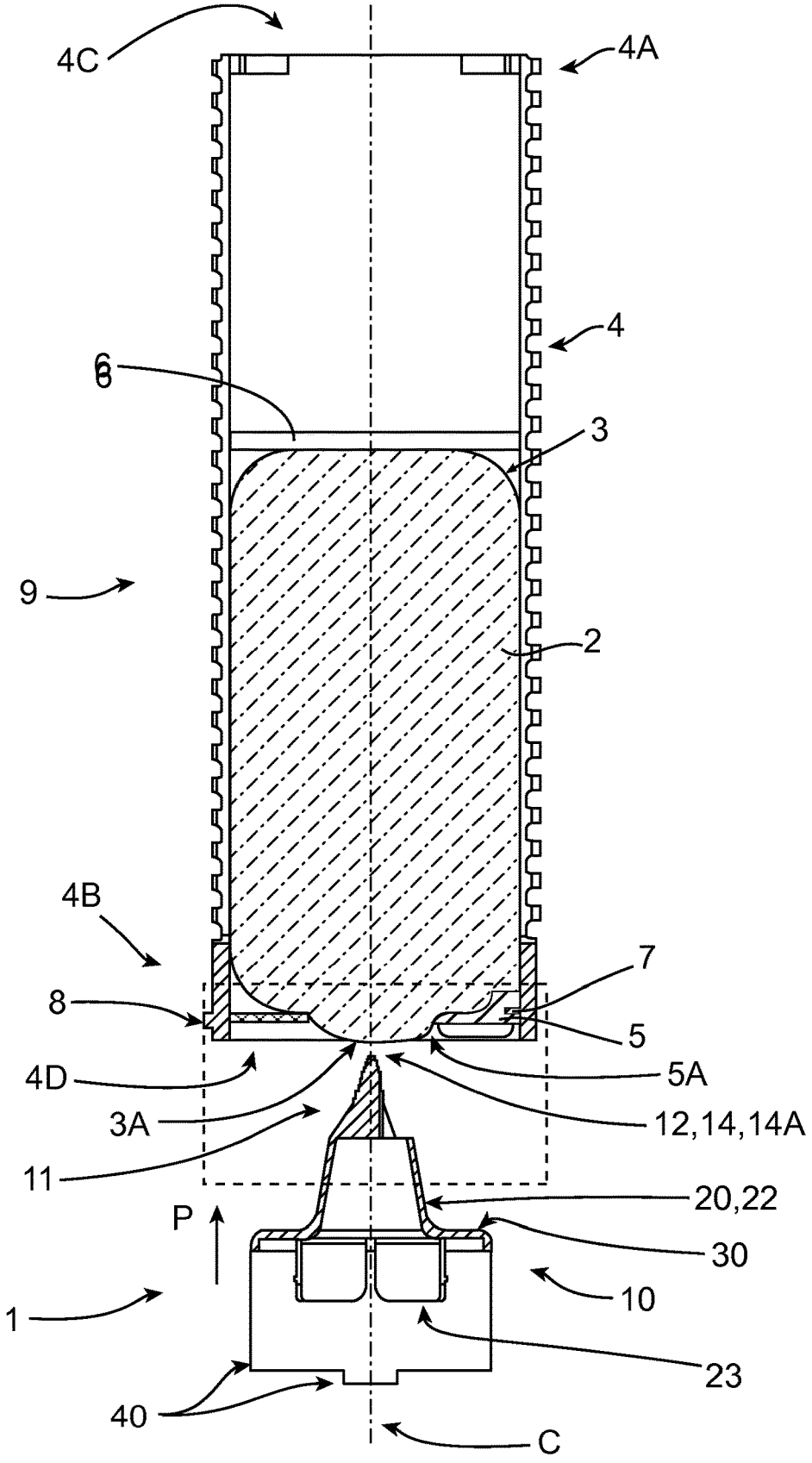
Figure 7:
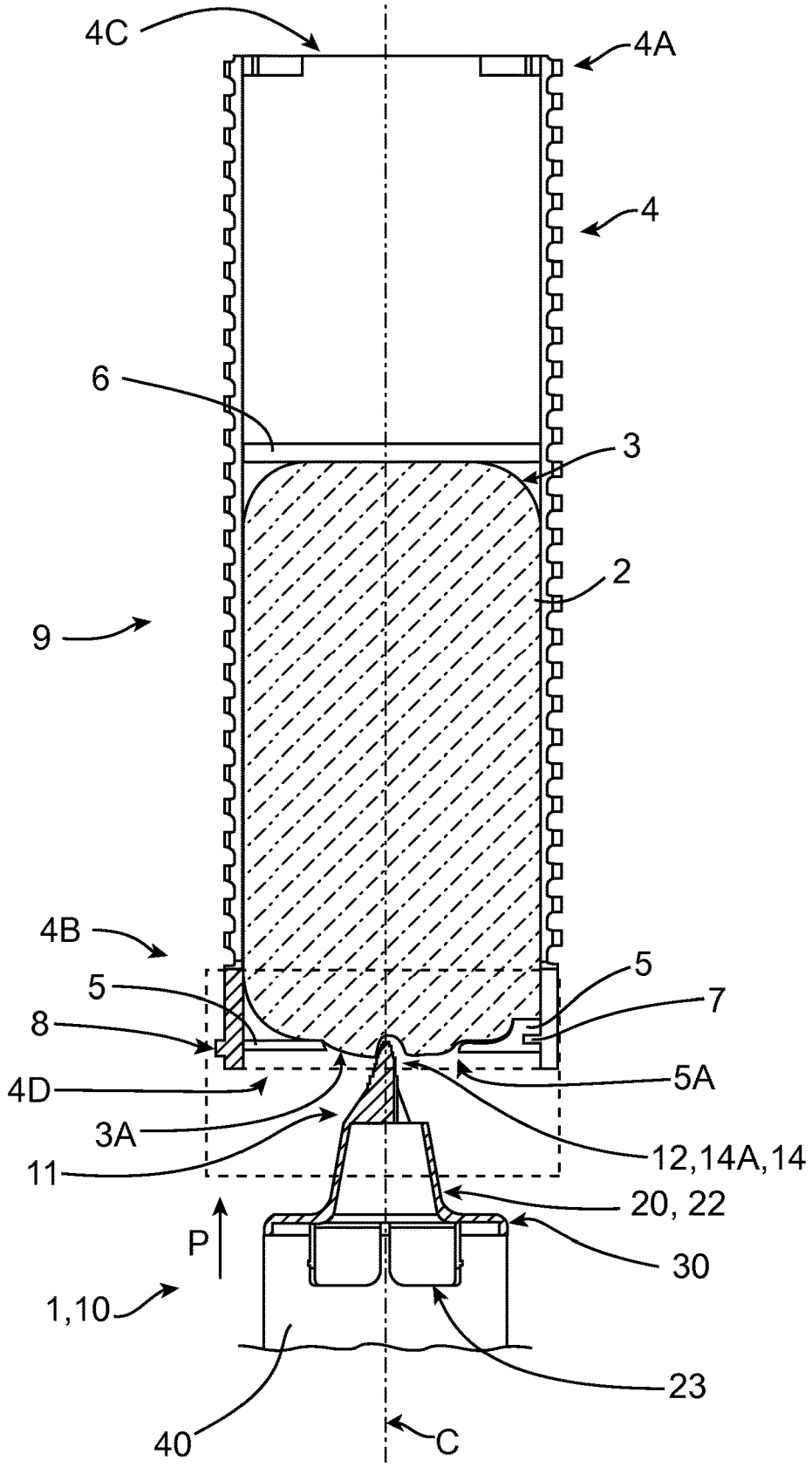
Figure 8:
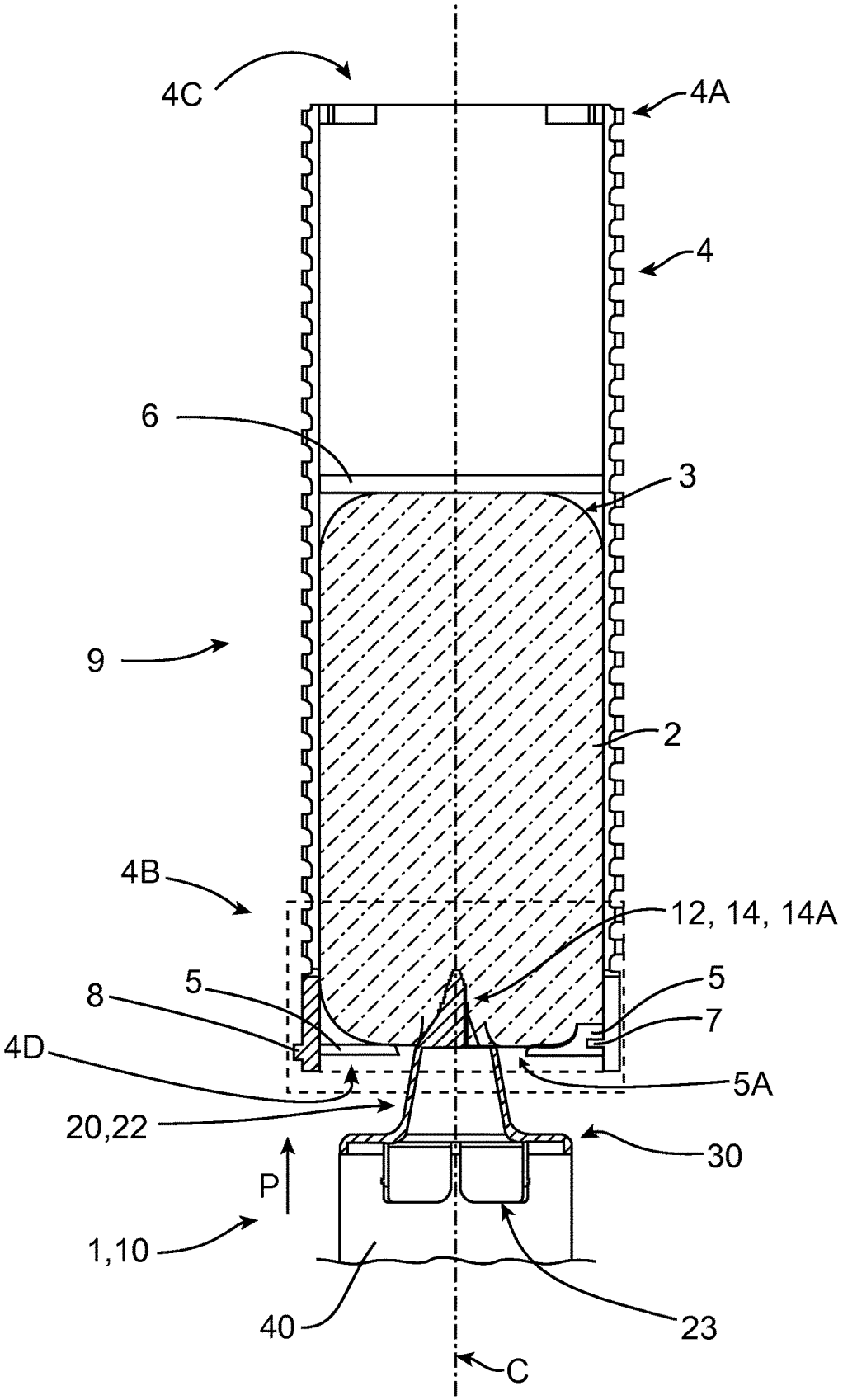
Figure 9:
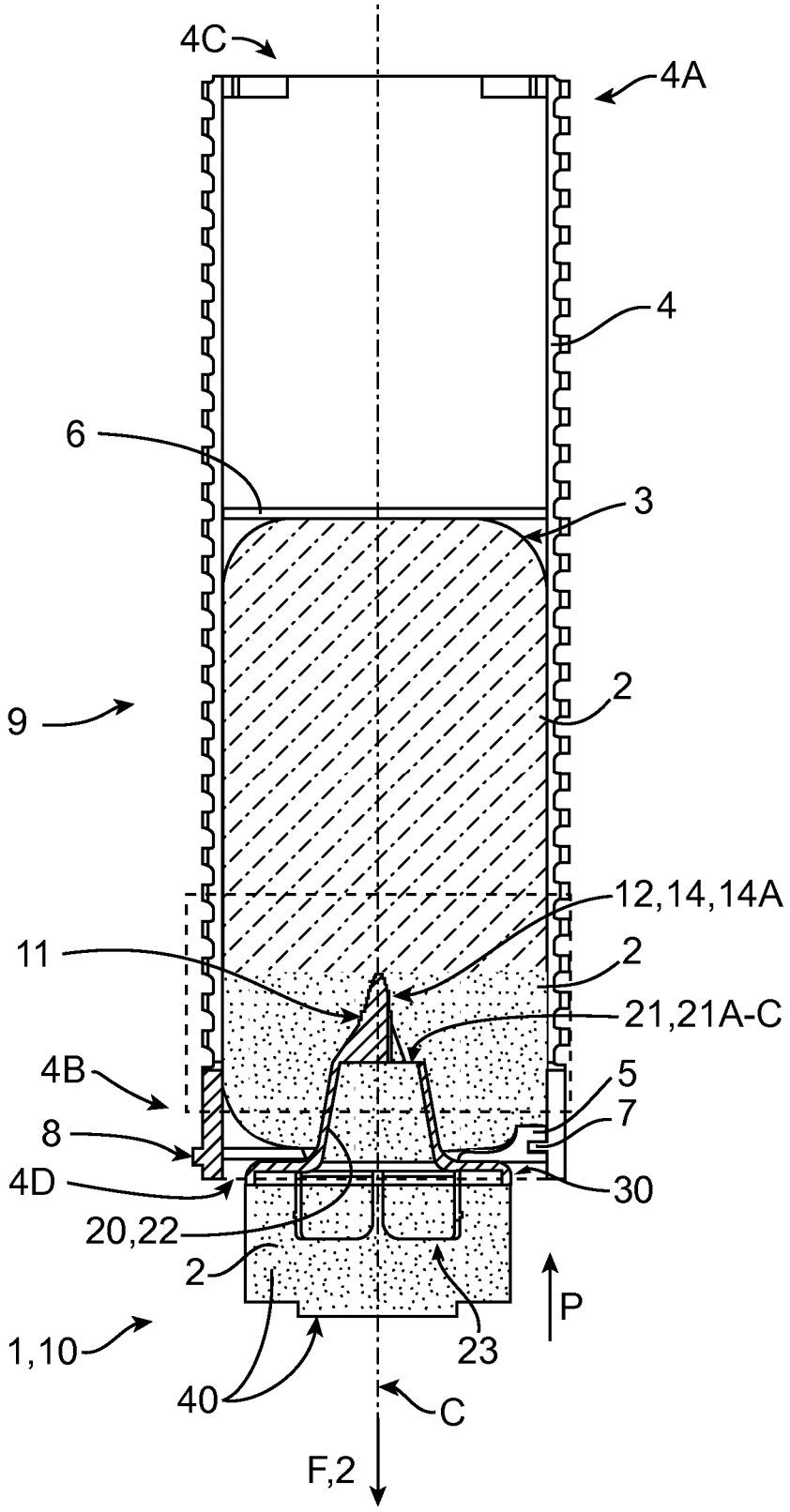

A device 1 shown in FIGS. 1-16B according to the invention is intended to produce dispense of food product 2 out of a flexible/compressible food container 3. The food product or the food 2 is primarily pasty, liquid or in fluid form without too large solid particles, preferably a negligible amount of such. The food product 2 is a type sensitive to air, e.g. dressing, mayonnaise, mustard, ketchup, peanut sauce or similar, but can be another type of sauce or dressing, or a beverage.

The container 3 is made of a material with the ability to collapse when the food is discharged by being squeezed out of the same and is made of a plastic material with barrier properties which guarantee that the food can be stored in the container air-tight and for a longer period of time at room temperature without risk of bacterial effects. The plastic material from which the container 3 is made is in the form of a plastic foil with special properties.

To empty/discharge food product 2 from the container 3 and dispense it from the same (see arrow at the references F, 2 in the lower part of FIGS. 1, 9 and 10), the container is placed in an outer container 4 (see upper part of FIGS. 1, 6-9, 13, 14, 16A-B) through a first opening 4C from a first end 4A of the same. The first end 4A can be provided with a first removable end lid (not shown) which then is put back over the container 4 after the placement of the container. At the other end 4B of the outer container 4 there is also placed an end part 5 or another end lid, which can be integrated into the outer container 4, or removable. In FIGS. 1 and 2 to 9, the first end lid is removed so that the container 3 can be placed in or taken out of the outer container 4.

Manual force is preferably used to pressurize the container 3, with the purpose of being able to more easily connect the coupling device 1 to it and then manually discharge food product from the container which is placed in the outer container 4 having an inner space. This is achieved by placing an inner press part 6 or a piston or pressure plate in the outer container 4 after the container has been put therein, and pushing the press part 6 towards the container's 3 one end in the direction away from the outer container's first end 4A towards its other end 4B where the end lid 5 is firmly positioned via a removable turnable fixing, e.g. in bayonet-style, and resists the container's other end when its first end is pressed, similar to an anvil, at least partially with its extension. The pressurization of the container and the discharge can be motorized, e.g. with an electric motor being controlled in a suitable manner. The container 3 is mainly arranged with its one end at the other end 4B or the start end on the outer container 4 after a full such container has been placed in the container at the actual starting position before discharge of food product starts (see initial/rest position in FIGS. 2 and 6 and a final/end/maximal bottom position in FIGS. 5 and 9). The end lid 5 has a central opening 5A in the form of a hole. When the container 3 is sufficiently pressurized, i.e. it has an internal suitable overpressure, its plastic foil will be aligned and be stretched out sufficiently to be able to render a certain amount of resistance and to avoid folds in the same before and after penetration of an outlet valve 10 according to the invention (see FIGS. 2-5). In certain cases the plastic foil will partially bulge out through the opening of the end lid 5A (see FIGS. 6 to 7) when the container 3 has reached a certain internal overpressure. This alignment/stretch and/or bulging 3A of a part of the container is necessary as it is made of flexible plastic foil, which would otherwise be too 'slack', not under tension or too loose to be able to be penetrated in a controlled manner, and this means that a distinct, exact and also repeatable alignment and tensioning and leakage-free penetration and small force is required for penetration of a part of the container. This in combination with the design of the coupling device 1 gives a repeatable and simply per-formable penetration, i.e. penetration of and through the container's plastic foil, and leakage-free joining of the coupling device 1 and a dosing device 9 at least comprising the outer container 4, the end lid 5, the press part 6 and the container 3. Coupling device 1 comprises at last one outlet valve 10 and a discharge part 40, which parts are adapted for detachable and leakage-free assembly with each other and a stand or a foot 50 (see FIGS. 13, 15A-B, 16A-B). Stand 50 is intended to support dosing device 9 in a vertical position when its container 3 has been penetrated by the coupling device 1 in the penetration direction P and the coupling device has been inserted therein to a final position where food product 2 can be dispensed (see FIGS. 16A and 16B) in the discharge direction F. The penetration direction P and the discharge direction F are in opposite directions.

The end lid 5 can be a part which is integrated into the outer container 4, i.e. not removable. The space in the outer container 4 can contain flexible containers 3 of different sizes. Coupling device 1 and dosing device 9 and their constituent parts are mainly made of plastic approved for food. In FIGS. 1 to 5 there is no end lid in the outer container 4 as this outer container only has an opening 4D adapted to the outlet valve 10, at its other end 4B.

Figure 13:
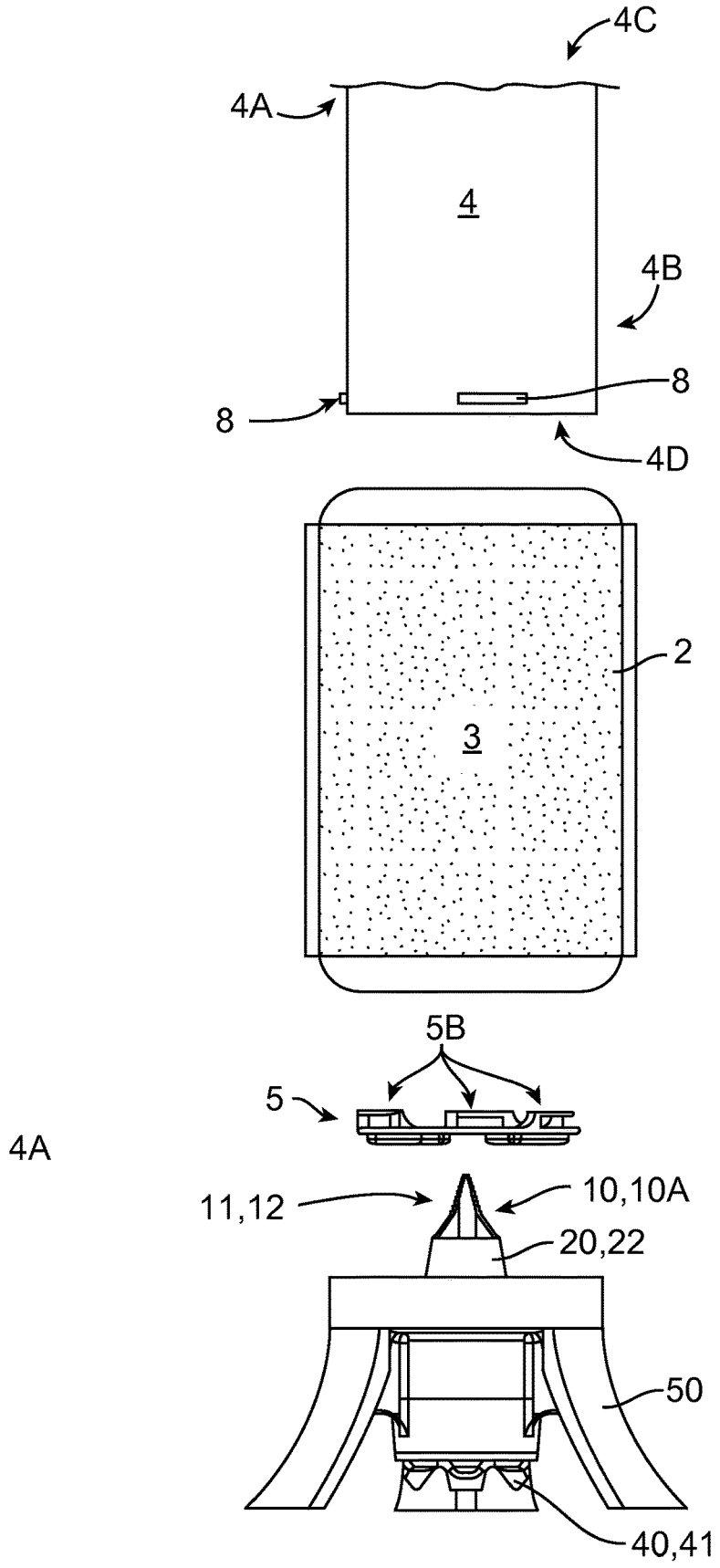
FIG. 13 shows in a side view the dosing device according to FIGS. 6 to 9 in an exploded view in a disassembled state or during/before assembly of all parts for food discharge, and coupling device according to FIGS. 1 to 9, removably connected to a stand.
Figure 14:
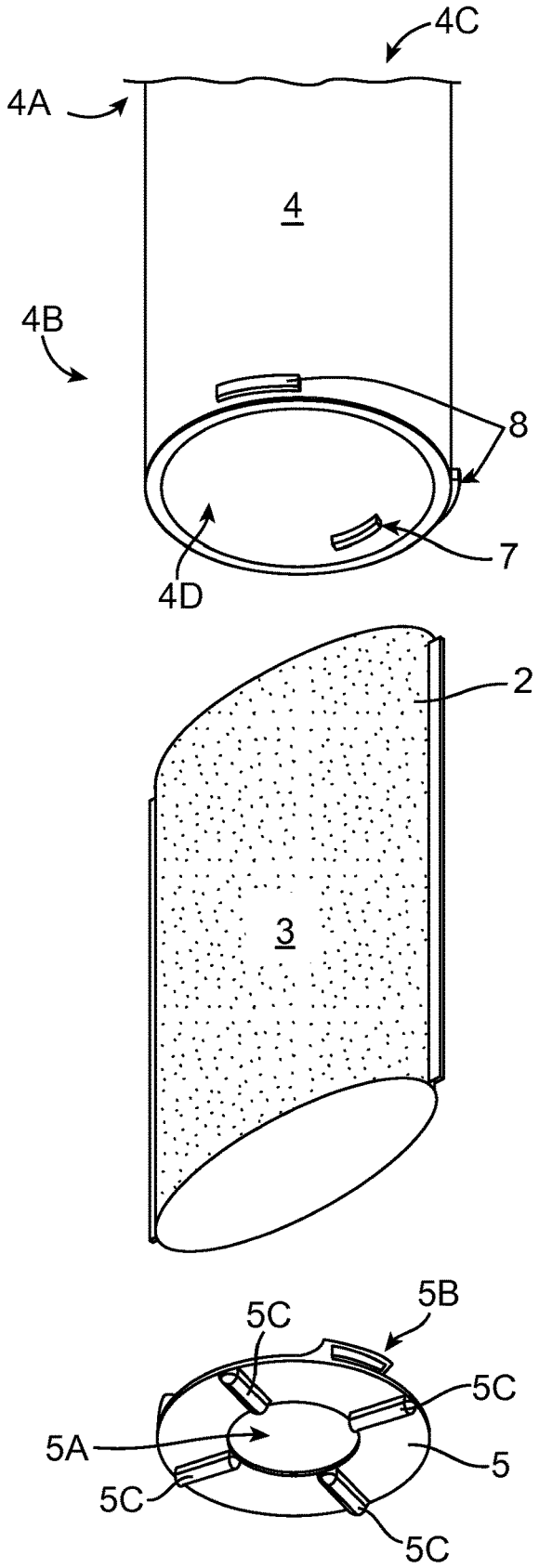
FIG. 14 shows in a perspective the dosing device according to FIGS. 6 to 9 in an exploded view, i.e. in a disassembled state or during/before assembly of all parts for food dispense.
Figure 15A:
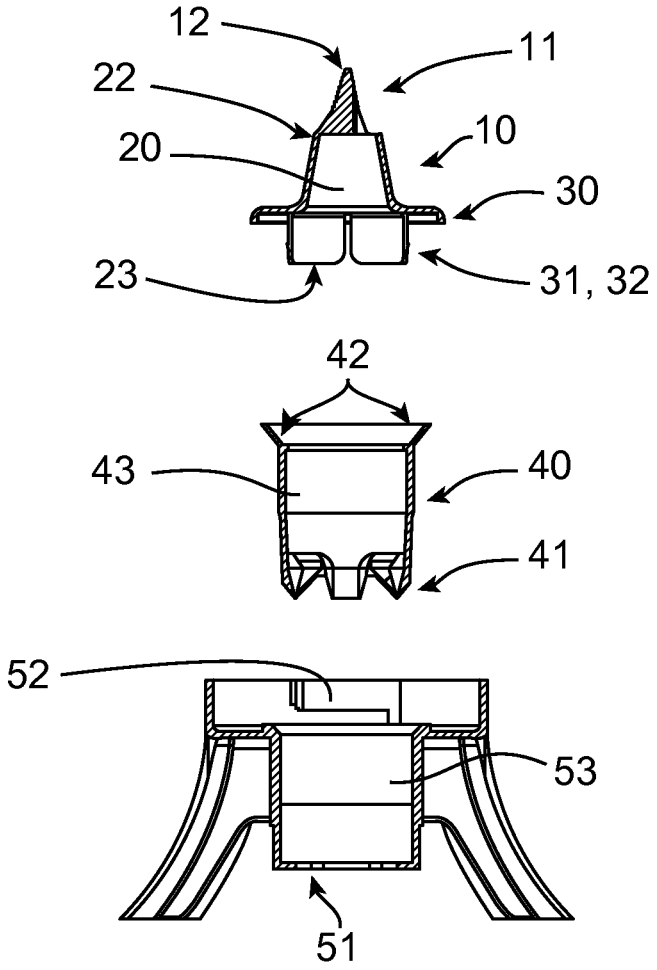
FIG. 15A shows in a side view the coupling device according to FIGS. 1-9 in an exploded view, i.e. in a disassembled state or during/before assembly/connection of all parts before penetration of the food container in the dosing device.
Figure 15B:
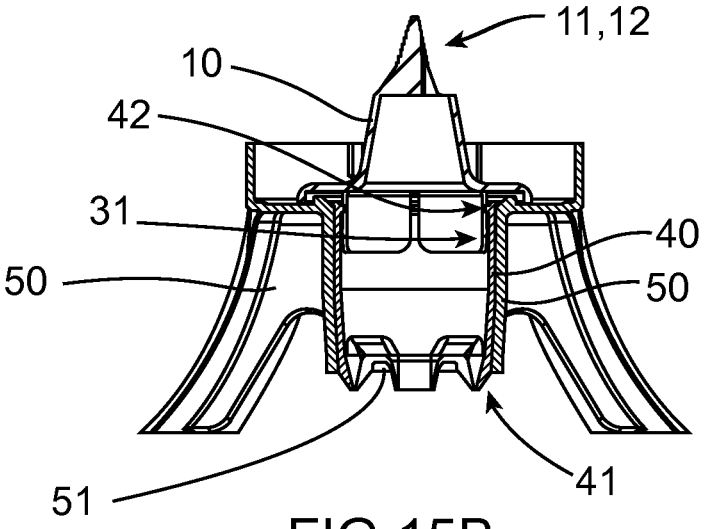
FIG. 15B shows a side view and in section the coupling device according to FIGS. 1 to 9, removably assembled to the stand.
Figure 16A:
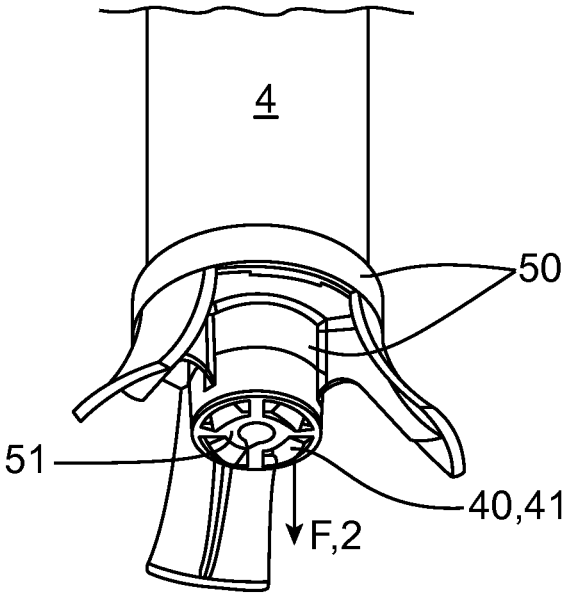
FIG. 16A shows a view in perspective of the dosing device according to FIGS. 1 to 9 and the coupling device according to FIGS. 1 to 9, assembled before and during discharge of food according to the invention.
Figure 16B:
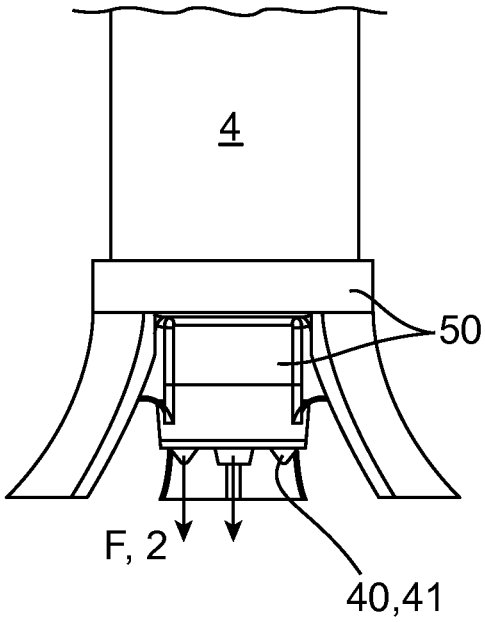
FIG. 16B shows in a side view the dosing device according to FIGS. 1 to 9 and the connection device according to FIGS. 1 to 9 assembled before and during discharge of food according to the invention.

The removable press part 6 works as a piston adapted to be displaced axially inside and along the dosing device's outer container 4 from the rest position at the outer container's first end 4A (the piston 6 is not shown in FIGS. 2-5, but is shown in FIGS. 6-9), where the container 3 has not yet started to be emptied of food product 2 to the maximum position closer to the other end 4B when the container is essentially or completely emptied, i.e. empty, and is to be replaced by a new full one. The piston 6 abuts and presses against the container 3 to compress the same during pressing discharge of food product 2 during its axial movement along the outer container. The piston 6 is seen in the upper part of FIGS. 6-9 before it has reached its maximum position (not shown) as a movable bottom or wall in the outer container 4, against which the container 3 must be/comes into contact with after it has been placed in the outer container through its opening 4C at the first end 4A according to FIGS. 2 to 9. FIGS. 13 and 14 show the dosing device 9 disassembled without the press part 6.

The outlet valve 10 is placed with a first end 10A comprising at least one hole-creating part 11 for penetration of the container 3 when connecting against the same. The hole-creating part 11 is an axially protruding arrow-head or spear-like part, with an outermost top 12 which is designed as a compromise between being sufficiently pointed for penetration of the container 3 but adequately/sufficiently blunt to not injure the user's fingers/hand. The outlet valve 10 and its hole-creating part 11 are hollow to be able to allow lead-through of food product 2 onwards to an outlet. The outlet valve 10 also comprises a substantially but at least partially cylindrical and/or at least partially conical through-flow channel 20 which merges into another end 10B of the outlet valve for further passage of the through-flowing food product when it is being dispensed. The outer top/part 12 of the hole-creating part 11 is designed as an axially protruding and at least partially hollow spear point. The point 12 is, however, at least partially solid in order to give better strength and sufficient stiffness, at least in FIGS. 11A and 12A where only one edge, 13, 13A will receive the forces when the container 3 is punctured by the outlet valve 10. The point 12 is adapted to directly continue into at least one, two, three or more radially protruding edges 13, 13A-C configured to run axially from its/their direct physical connection (s) to the point 12 in the discharge direction F for the food product 2 (FIG. 1-12C) until connection or transition to an inlet orifice 21 for the through-flow channel 20. The outlet valve 10 and its hole-creating part 11 are hollow with the inlet orifice 21 and an outlet orifice 23 to be able to allow lead-through of food product 2. If an edge 13, 13A divides the outlet valve's inlet orifice 21, an opening 21, 21A (see FIGS. 11A and 12A) is achieved. If two edges 13, 13A-B divide the outlet valve's inlet orifice 21, at least two openings 21A-B are achieved symmetrically (see FIGS. 11B, 12B). If three edges 13, 13A-C divide the outlet valve's inlet orifice 21, at least three openings 21, 21A-C are achieved symmetrically (see FIGS. 11C, 12C). This means that food product 2 can be dispensed out of the container 3 via one, two, three or more orifice openings 21A-C, preferably three, in the outlet valve 10 after the container has been penetrated by the spear point 12 and the coupling device 1 has penetrated into its bottom position in the container (see FIGS. 5, 9 and 16A and 16B).

Figure 10:
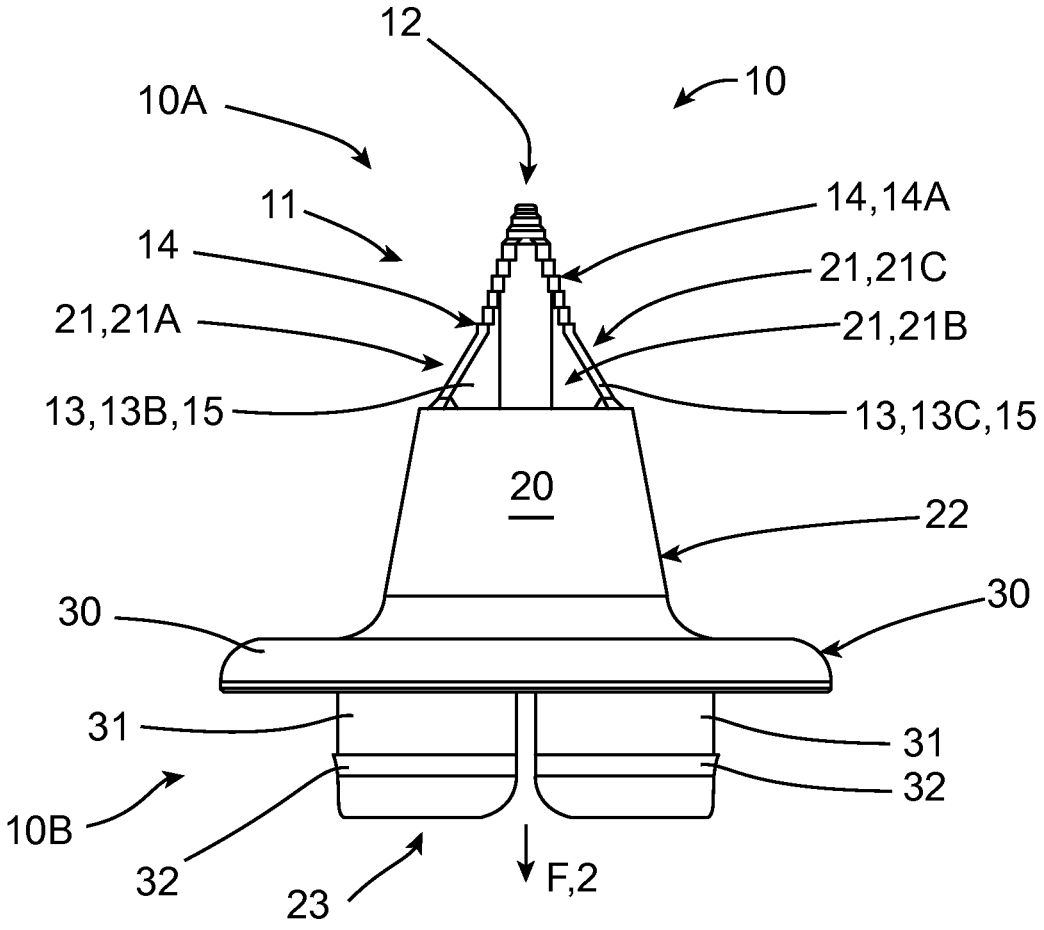
FIG. 10 shows in a side view an outlet valve for the coupling device in FIG. 1.
Figure 11A:
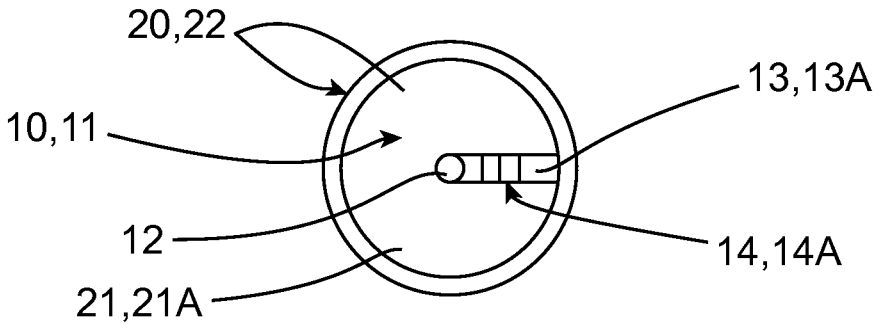
FIGS. 11A-11C show in plan views from above the outlet valve in FIGS. 1 to 10 seen in the direction towards its point and inlet opening, i.e. seen in a direction mainly parallel with the centre axes of the coupling and dosing device.
Figure 11B:
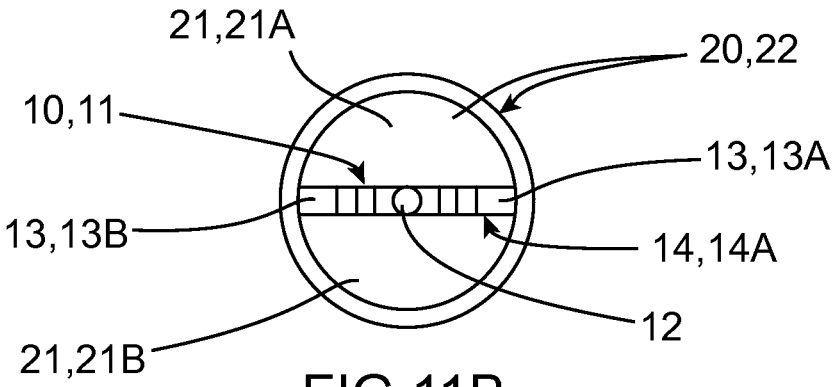
Figure 11C:
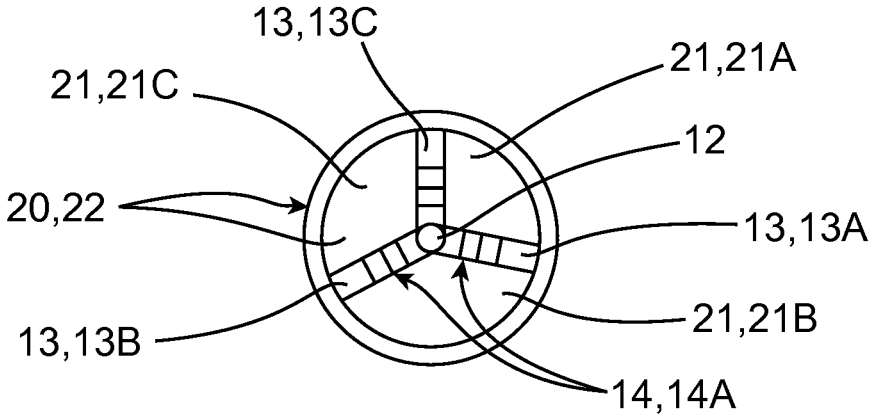
Figure 12A:
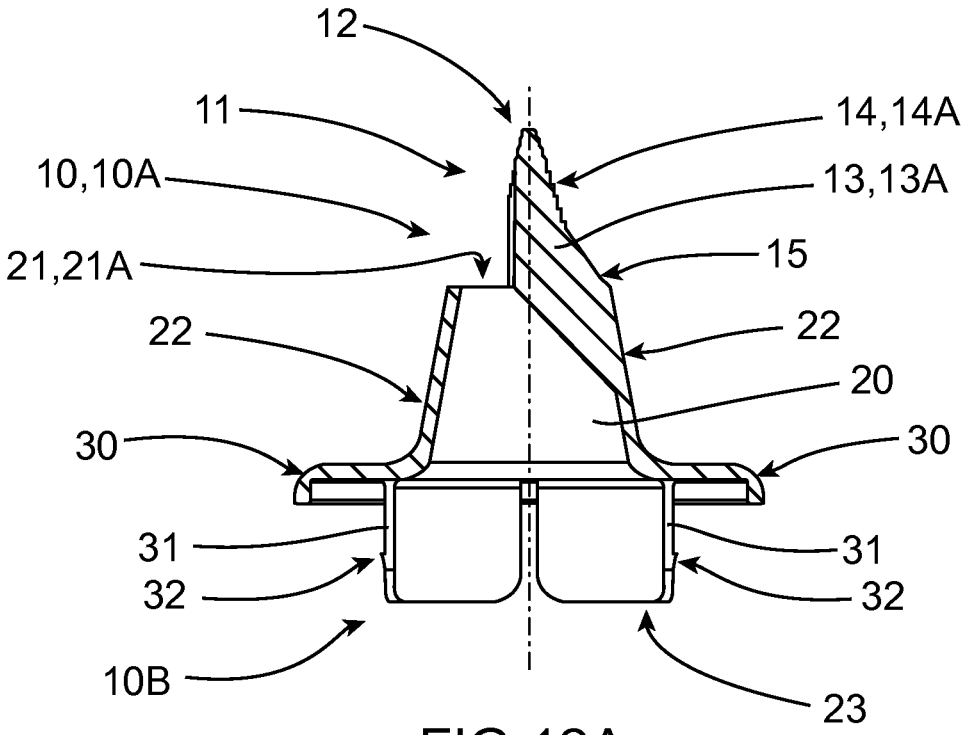
FIGS. 12A-12C show in sections and from the side different variants/embodiments of the outlet valve in FIGS. 1 to 11C.
Figure 12B:
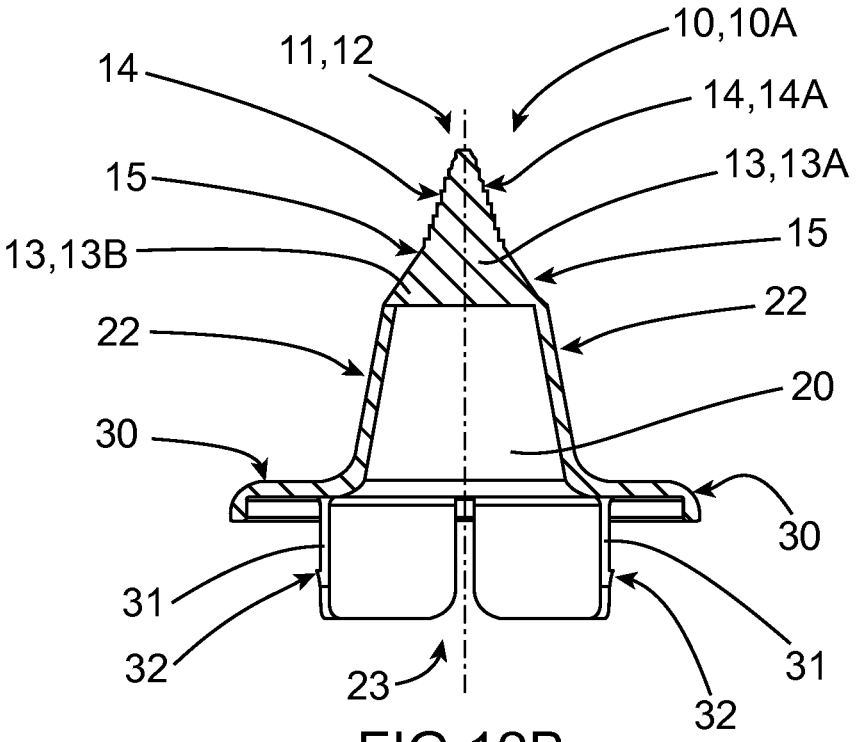

The hole-creating part's point 12 is designed as an axially protruding spear point in an embodiment shown in FIGS. 11A and 12A. The point 12 is at least partially hollow and merges directly into a radially protruding edge 13, 13A in the direction against the through-flow channel 20, which edge merges into its inlet orifice 21, 21A. The edge 13, 13A connects to the inlet orifice 21 in such a way that the inlet orifice is divided into a large relatively symmetric opening 21A. The hole-creating part's point 12 is designed as an axially protruding two-edged spear point in an embodiment shown in FIGS. 11B and 12B. The two-edged point 12 is at least partially hollow and merges directly into two radially protruding edges 13, 13A-B in a direction towards through-flow channel 20, which edges merge into its inlet orifice 21. The edges 13, 13A-B connect to the inlet orifice 21 in such a way that the inlet orifice is separated into two symmetric openings 21A-B. The hole-creating part's point 12 is designed as an axially protruding triangular spear point in an embodiment shown in FIGS. 1-10, 11C, 12C, 13, 15A-B. The triangular point 12 is at least partially hollow and directly into three radially protruding edges 13, 13A-C in the direction towards through-flow channel 20, which edges merge into its inlet orifice 21. The edges 13, 13A-C connect to the inlet orifice 21 in such a way that the inlet orifice is separated into three symmetric openings 21A-C. The advantage of symmetrically shaped openings 21A-C is that the flow of food product 2 is evenly distributed between them when being dispensed out of the container and flow through the inlet orifice 21. In one or more of the embodiments above, the point 12 merges into one or more edges 13, 13A-C without interruption, i.e. the point is a beginning of or is an integrated first part of each edge.

The through-flow channel 20 in the outlet valve 10 is designed with a conical or at least partly conical outer envelope surface 22. The envelope surface 22 has an increasing size or circumference or diameter (if circular in cross-section) in the direction from inlet orifice 21. The coupling device 1 is designed such that the axial centre axis for the hole-creating part's point 12 and the axial centre axis for the through-flow channel 20 and its inlet orifice 21, i.e. its middle, and axial centre axis C for the whole outlet valve 10 and the dosing device 9 coincide but do not necessarily have to coincide, i.e. not coinciding exactly in line with each other.

Figure 12C:
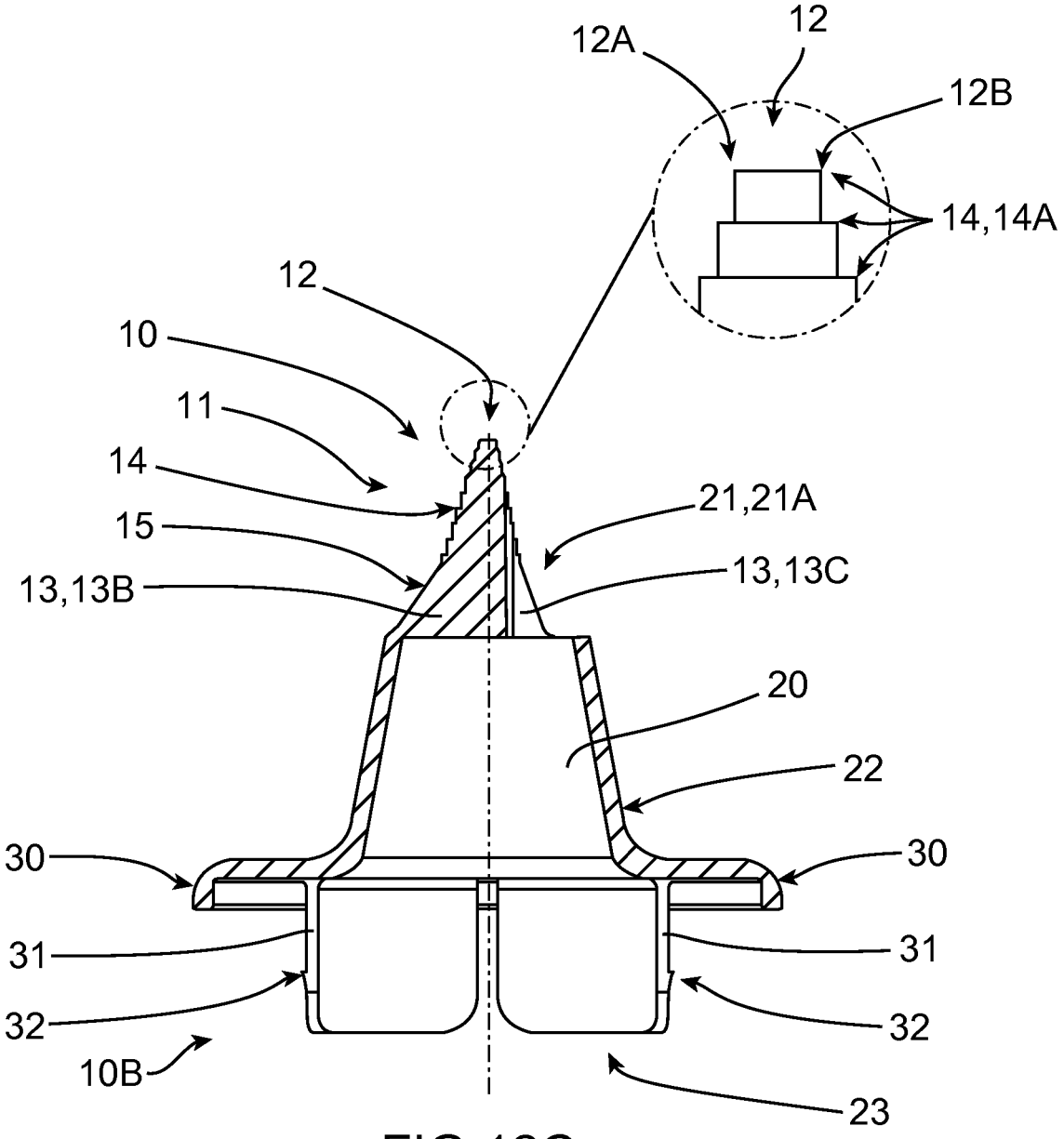

In one embodiment, each protruding spear point edge 13, 13A-C on the hole-creating part 11 is arranged to extend along a plane which is substantially parallel with or wholly parallel with the point's 12, the through-flow channel's 20 and its inlet orifice's 21 and the outlet valve's axial centre axes C. In one embodiment the axial centre axis C for the whole outlet valve 10 and the dosing device 9 coincides with the axial centre axes for the discharge part 40 and/or the stand 50 when they are assembled for use, i.e. food dispense. In another embodiment at least one of the radially protruding spear point edges 13, 13A-C is provided with at least one tooth 14 at least partially along its outermost and facing outwards surface 15. In FIGS. 1-13 and 15A-15B the hole-creating part 11 is shown with a plurality of teeth 14 on each spear point edge 13, 13A-C, e.g. four to ten of these, five to eight of these or six such teeth. Point 12 is provided with at least one similar tooth 14A, preferably with a surrounding tooth, e.g. two to three such ones, or more. Each tooth 14, 14A, works as a cutting part or cutting element/thread/thread segment on the point 12 and/or each point edge 13, 13A-C with a configuration that makes it possible to cut up the container's plastic foil when the hole-creating part 11 penetrates the same, so that the plastic foil is not split or torn up with an uneven or asymmetric hole, but instead creates a uniform hole. In FIG. 12C an enlargement of the point 12 is shown on the outlet valve 10 (this enlargement is applicable also to point 12 shown in FIGS. 12A and 12B), where the point 12 is divided into at least two smaller point parts 12A and 12B, and teeth 14 and 14A, which teeth also continue down for each edge 13, 13A-C. Partial points 12A and 12B produce a perforation of the plastic foil in the container 3 in the form of small, initial breaks when point 12 penetrates into it, whereby the plastic foil does not split abruptly but is penetrated with a controllable propagation of the points 12, 12A-B through the container and is slipped further down over the hole-creating part 11.

In one embodiment at least one tooth 14, 14A on at least one spear point edge 13, 13A-C, and/or the point 12, 12A, 12B configured as a step and/or a shelf which faces mainly/essentially outwards with at least one outermost cutting edge which is sharp but not so sharp that users can cut themselves on it. This outermost cutting edge extends in a plane substantially perpendicular or perpendicular to the axial extension of the spear point edge, which is substantially parallel or completely parallel with the centre axis C of the outlet valve. In another embodiment at least one tooth 14, 14A on at least one spear point edge 13, 13A-C and/or the point 12, 12A, 12B is configured at least partially as a thread segment which faces substantially radially outwards with at least one outermost thread part and/or profile edge which is sharp but not so sharp that users can cut themselves on it, and extends in a plane at least partially angled against the spear point edge's axial expanse which is essentially or mainly parallel or parallel with the outlet valve's centre axis C. Each tooth 14, 14A is also configured such that the plastic foil is not sawed through but is only cut through with the intent not to risk that any removal of the plastic foil occurs with a risk that small pieces of the same come off during and after the penetration and end up in the food product 2.

In one embodiment at least two or three or each of the spear point edges 13, 13A-C are configured with at least one tooth 14 each. Each tooth 14 is configured like a step or a shelf which faces mainly radially outwards with at least one outer cutting edge which is sharp but not so sharp that users can cut themselves on it, and extends in a plane mainly perpendicular to the axial expanse of the spear point edge, which is mainly parallel or parallel with the outlet valve's centre axis C. In another embodiment at least two or three or each of or all spear point edges 13, 13A-C have an axial expanse which together creates an at least partially conical outer mantle surface with an at least partially even and/or uniform and/or symmetrical or at least partially uneven and/or non-uniformly and/or asymmetrically increasing size or circumference or diameter (if the cross section is circular) in the direction from point 12 towards the outlet valve's other end 10B and merges into the hollow part 20 and its conical mantle surface 22. Each spear point edge 13, 13A-C has a conicity or angle of extension which corresponds to the conical mantle surface but these edges and surfaces can also have different conicities and angle and in some cases have a varying conicity and/or angle along its extent. The edges 13, 13A-C have the same width or thickness as shown in FIGS. 10, 11A and 11B or different widths/thicknesses as in FIG. 11C or two edges 13A and 13B can have the same width/thickness while a third edge 13C has another.

The end lid 5 which is a counterforcing end portion/hole disc comprises at least one or two or more protruding tongues 5B for demountable connection to the inside of the outer container's other end 4B. End lid tongues 5B are arranged on one side of the end lid 5 (upper/first side in FIGS. 13-14). End lid tongues 5B are adapted for removable connection using twisting, like a bayonet catch, with internal protrusions 7 that protrude radially inwards on the inside of the outer container for detachable connection of the end lid or hole disc 5 and the outer container's other end 4B. The end lid 5 comprises external ribs 5C on its other side (lower side opposed to the first/upper side of the end lid) for vertical support against stand 50 so that a gap or elevation between end lid 5 and the stand is created, wherein a connection part 30 in the form of a flange in connection with the outlet valve's other end 10B has enough space between them in the axial direction.

The hole-creating part 11 in one embodiment comprises a first radially protruding edge 13A being a direct extension of point 12, a second radially protruding edge 13B being a direct extension of point 12 and a third radially protruding edge 13C being a direct extension of point 12. Each of these point edges 13, 13A-C comprises at least one or several outer radially outwards facing surfaces 15.

In one embodiment of the outlet valve 10, its through-flow channel 20 comprises a first opening 21A in its inlet orifice 21, a second opening 21B in the inlet orifice and a third opening 21C in the inlet orifice. The three openings 21A-C create the inlet orifice 21. In another embodiment the outlet valve 10 comprises at least one or several protruding flanges 31 that function as guiding parts when the outlet valve is introduced into a substantially or at least partially cylindrical or totally cylindrical inner through-flow channel/space 43 in discharge part 40 during assembly (FIGS. 15A, 15B and 16A, 16B). In yet another embodiment the outlet valve's flanges 31 comprise hooks or points 32 for dismountable connection to the discharge part 40 (FIGS. 12A-12C, 15A and 15B). The detachable connection of outlet valve 10 and discharge part 40 is achieved by the outlet valve's points 32 being led past at least one inner radially inwards facing and circumferential edge 42 which is continuous or discontinuous or consists of several smaller edges on the inside of the discharge part's inlet with a snap-like hooking, see the final bottom position where the outlet valve 10 has been introduced all the way into the discharge part 40 in FIG. 15B. In yet another embodiment, the hollow discharge part 40 comprises the lower and outer tabs 41 at its outlet orifice where the food product 2 finally is dispensed/portioned out via nozzles in the form of the tabs 41 to control the direction of the food product's outflow and its distribution at the discharge (FIGS. 15A-16B). Tabs 41 look like external beaks with the purpose of guiding the discharge part 40 in stand 50 when it has been introduced into the same.

In one embodiment, stand 50 comprises guiding parts 51 for detachable connection to the discharge part's tabs/beaks 41. The guiding parts 51 aligns discharge part 40 into a correct final position when it has been inserted into its final place, i.e. at the bottom of stand 50 (see FIGS. 15A-16A). In another embodiment, the stand 50 comprises internal edges or tongues 52 which are pointed radially inwards at the upper part of the stand (see FIGS. 15A and 15B) for a demountable connection with dosing device 9. The detachable connection of stand 50 and dosing device 9, i.e. its outer container 4, is per-formed through twisting, like that of a bayonet catch, as with assembly of end lid 5 with the inside of the outer container. The connections can be made with either clockwise or counter-clockwise relative turning of a part 4, 5, 50 or both parts 4, 5 or 4, 50 which are to be connected. The stand tongues 52 are adapted to twistable be fitted into external protrusions 8 at the outside of the external container at its other end 4B, which protrusions 8 protrude radially outwards on the outside of the outer container, i.e. in a direction opposite to its inner protrusions 7 at its other end 4B. Stand 50 comprises a substantially or at least partially cylindrical or fully cylindrical inner space 53 for reception and housing of the coupling device 1. Stand 50 can have a design other than three legs, e.g. four or more or be designed as a circumferential edge or ring.

NOMENCLATURE

1: Coupling device (comprising at least one outlet valve 10 and discharge part 40).
2: Food product (liquid/fluid form).
3: Compressible/Flexible and pressurized food container. 3A Bulging part of container.
4: Outer container for placement/removal of container. 4A: First end of outer container. 4B: Second end of outer container. 4C: First opening in outer container. 4D: Second opening in outer container.
5: End/Counterforcing end portion/hole disc/lid. 5A: Hole/Opening in end portion/-lid. 5B: Protruding tongues for demountable connection to the inside of outer container. 5C: External ribs on the lower side of the hole disc for support against stand 50.
6: Press-part/Piston/plate (for pressurization of container 3).
7: Internal protrusions on the inside of the outer container for removable connection with hole disc 5.
8: External protrusions on the outside of the outer container, for detachable connection with stand 50.
9: Dosing device (comprising at least one outer container 4, hole disc 5 and container 3).
10: Outlet valve. 10A: First end of outlet valve for penetration of container.
10B: Second end of outlet valve for further transfer of food product.
11: Hole-creating part for penetration of the food container.
12: Outermost part of the hole-creating part in the form of a point/spear point.
12A: First point part. 12B: Second point part.
13: Radially protruding edges as extension of point 12. 13A: First radially protruding edge as extension of point 12. 13B: Second radially protruding edge as an extension of point 12. 13C: Third radially protruding edge as an extension of point 12. 14: Cutting part/element/groove/thread/thread segment on point edge. 14A: Cutting part/element/groove/thread/thread segment on the point 12. 15: Outer radially outward facing surface on the point edge 13, 13A-C.
20: Mainly inner cylindrical through-flow channel in the outlet valve.
21: Inlet orifice for through-flow channel. 21A: First opening in inlet orifice of through-flow channel 20. 21B: Second opening in inlet orifice. 21C: Third opening in inlet orifice.
22: Conical/Cone-shaped outside/outer surface/envelope surface of the through-flow channel.
23: Outlet orifice of the through-flow channel.
30: Connection part for the outlet valve towards discharge part 40. 31: Protruding flanges on outlet valve 10. 32: Hooks/points for demountable connection to discharge part 40.
40: Hollow discharge part which receives food product from the outlet valve for final dispense/portioning via nozzles formed by tabs 41. 41: External tabs/beaks for guiding entry into stand 50. 42: Internal radially inwards facing edges for connection with hooks 32. 43: Mainly inner cylindrical through-flow channel in the discharge part.
50: Stand/Foot for support and joining to outlet valve and dosing device 9.
51: Controlling parts for demountable connection to the tabs 41 of the discharge part.
52: Internal edges for demountable connection to dosing device 9. 53: Mainly inner cylindrical space for reception of the connection device 1.
C: Axially extending centre axis. F: Discharge direction for food product 2.
P: Penetration direction for outlet valve 10.

The invention claimed is:

1. Coupling device for connection to a flexible container comprising a plastic foil for dispensing of food product in fluid form out of the same, comprising an outlet valve with a first end comprising at least one hole-creating part for penetration of the container and its plastic foil when connecting to the same, and a through-flow channel which merges into a second end for transfer of food product, where an outer portion of the hole-creating part is configured as an axially protruding edged spear point being at least partially hollow and having an arrow-head shape, which point merges into one or more radially protruding configured to extend axially from the point in direction of the dispense for food product towards the through-flow channel and to merge into an inlet orifice at the through-flow channel, which radially protruding edge(s) extends radially outwards away from the axially protruding edged spear point towards the inlet orifice and end(s) at the inlet orifice to form the arrow-head shape of the axially protruding edged spear point, which arrow-head shape points/faces away from the through-flow channel, wherein food product can be discharged from the container via orifice openings after the container has been penetrated by the axially protruding edged spear point which is provided with a plurality of outwards and radially pointing teeth, each radially pointing tooth working as a cutting element with radially pointing edges or corners or cutting edges and being arranged along the radially protruding edge(s) in such a way that the radially pointing teeth together form a stepwise configuration, which is configured to create a cutting effect on the container's plastic foil in at least two places in the plastic foil, wherein the through-flow channel is configured with a smooth conical outer mantle surface, said smooth outer mantle surface begins at a portion where the protruding spear point edge(s) ends and increases in diameter from the portion in a direction away from the inlet orifice and towards the second end of the outlet valve, wherein the smooth conical outer mantle surface is devoid of such outwardly and radially pointing teeth.

2. Coupling device according to claim 1, wherein the hole-creating part's point is configured as an axially protruding triangular spear point, which merges into three radially protruding edges which extend in a direction towards the through-flow channel.

3. Coupling device according to claim 2, wherein the protruding edges at the hole-creating part connect to the through-flow channel's inlet orifice and separates the inlet orifice into three openings.

4. Coupling device according to claim 1 adapted to the container made out of plastic foil.

5. Coupling device according to claim 4, wherein the coupling device is adapted for penetration of the container which is adapted to be housed in an outer container so that its plastic foil is stretched and therein aligned with and/or at least partly bulges through a counterforcing end portion in the outer container.

6. Coupling device according to claim 5, wherein responsive to the plastic foil being stretched and therein aligned with and at least partly bulges through the counterforcing end portion in the outer container, the coupling device is adapted to cooperate with the counterforcing end portion in the outer container which is equipped with a central opening through which the bulging plastic foil part of the container is adapted to be distended and aligned with the hole-creating part before its penetration.

7. Coupling device according to claim 1, wherein the through-flow channel is configured with a conical outer mantle surface which has an increasing circumference or diameter in the direction away from the inlet orifice.

8. Coupling device according to claim 1, wherein the axial centre axis for the hole-creating part's point and the axial centre axis for the through-flow channel and its inlet orifice and axial centre axis (C) for the outlet valve coincide or diverge relative to each other's expanse.

9. Coupling device according to claim 1, wherein at least one tooth on the point and/or at least one spear point edge is configured at least partially as a thread segment that substantially faces radially outwards with at least one outer thread part or profile edge which is sharp and extends in a plane at least partially angled towards the point's and/or the spear point edge's axial expanse.

10. Coupling device according to claim 1, wherein the point comprises at least two teeth and/or at least two of the spear point edges are configured with at least one tooth each, wherein each tooth is configured as a step that substantially faces radially outwards with at least one outer cutting edge which is sharp and which extends in a plane substantially perpendicular to the axial expanse of the point and/or the spear point edges.

11. Coupling device according to claim 1, wherein at least one radially protruding spear point edge is configured with an axial expanse that creates an at least partially conical outer mantle surface with an increasing size and/or radius and/or circumference and/or diameter in a direction away from the spear point.

12. Coupling device according to claim 1, wherein at least one radially protruding spear point edge is in direct connection with the spear point, which means that the spear point physically merges directly into at least one spear point edge.

13. Coupling device for connection to a flexible container comprising a plastic foil for dispensing of food product in fluid form out of the same, comprising an outlet valve with a first end comprising at least one hole-creating part for penetration of the container and its plastic foil when connecting to the same, and a through-flow channel which merges into a second end for transfer of food product, where an outer portion of the hole-creating part is configured as an axially protruding edged spear point being at least partially hollow and having an arrow-head shape, which point merges into one or more radially protruding edges configured to extend axially from the point in direction of the dispense for food product towards the through-flow channel and to merge into an inlet orifice at the through-flow channel, which radially protruding edge(s) extends radially outwards away from the axially protruding edged spear point towards the inlet orifice and end(s) at the inlet orifice to form the arrow-head shape of the axially protruding edged spear point, which arrow-head shape points/faces away from the through-flow channel, wherein food product can be discharged from the container via orifice openings after the container has been penetrated in a linear direction (P) by the axially protruding edged spear point which is provided with a plurality of outwards and radially pointing teeth, each radially pointing tooth working as a cutting element with radially pointing edges or corners or cutting edges and being arranged along the radially protruding edge(s) in such a way that the radially pointing teeth together form a stepwise configuration, which is configured to create a cutting effect on the container's plastic foil in at least two places in the plastic foil, wherein the through-flow channel is configured with a smooth conical outer mantle surface starting at and extending from the inlet orifice of the through-flow channel, which smooth conical outer mantle surface has an increasing size in a direction away from the inlet orifice and to the second end of the outlet valve, wherein also the protruding spear point edge(s) comprises a plurality of such outwards and radially pointing teeth configured as steps that mainly faces radially outwards with at least one outermost cutting edge being sharp and extending in a plane substantially perpendicular to the point's and/or spear point edge's axial extension, wherein the smooth conical outer mantle surface is devoid of such outwardly and radially pointing teeth.

14. Coupling device for connection to a flexible container comprising a plastic foil for dispensing of food product in fluid form out of the same, comprising an outlet valve with a first end comprising at least one hole-creating part for penetration of the container and its plastic foil when connecting to the same, and a through-flow channel which merges into a second end for transfer of food product, where an outer portion of the hole-creating part is configured as an axially protruding edged spear point being at least partially hollow and having an arrow-head shape, which point merges into one or more radially protruding edges configured to extend axially from the point in direction of the dispense for food product towards the through-flow channel and to merge into an inlet orifice at the through-flow channel, which radially protruding edge(s) extends radially outwards away from the axially protruding edged spear point towards the inlet orifice and end(s) at the inlet orifice to form the arrow-head shape of the axially protruding edged spear point, which arrow-head shape points/faces away from the through-flow channel, wherein food product can be discharged from the container via orifice openings after the container has been penetrated by the axially protruding edged spear point which is provided with a plurality of outwards and radially pointing teeth along its whole axial direction, each radially pointing tooth working as a cutting element with radially pointing edges or corners or cutting edges and being arranged along the radially protruding edge(s) in such a way that the radially pointing teeth together form a stepwise configuration, which is configured to create a cutting effect on the container's plastic foil in at least two places in the plastic foil, wherein the through-flow channel is configured with a smooth conical outer mantle surface starting at and extending from the inlet orifice of the through-flow channel, which smooth conical outer mantle surface has an increasing size in a direction away from the inlet orifice and to the second end of the outlet valve, wherein also the protruding spear point edge(s) comprises a plurality of such outwards and radially pointing teeth configured as steps that mainly faces radially outwards with at least one outermost cutting edge being sharp and extending in a plane substantially perpendicular to the point's and/or spear point edge's axial extension, which radially pointing teeth only extend along a part of the protruding spear point edge(s).

* * * * *